US006112622A

United States Patent [19]

Reiman

[11] Patent Number: 6,112,622

[45] Date of Patent: Sep. 5, 2000

[54] FLUID-OPERATED TOOL

[75] Inventor: Jeff Reiman, Harrington Pk., N.J.

[73] Assignee: Unex Corporation, Mahwah, N.J.

[21] Appl. No.: 09/303,868

[22] Filed: May 3, 1999

[51] Int. Cl.[7] ..... B25B 13/46

[52] U.S. Cl. ..... 81/57.39; 81/57.44; 81/60

[58] Field of Search ..... 81/57.39, 57.44, 81/60, 61

[56] References Cited

U.S. PATENT DOCUMENTS

| | | | |
|---|---|---|---|
| 4,201,099 | 5/1980 | Junkers . | |
| 4,406,185 | 9/1983 | Junkers | 81/57.39 |
| 4,409,865 | 10/1983 | Krautter et al. . | |
| 4,644,829 | 2/1987 | Junkers | 81/57.39 |
| 5,005,447 | 4/1991 | Junkers . | |
| 5,103,696 | 4/1992 | Beuke | 81/57.39 |
| 5,388,478 | 2/1995 | Castle | 81/57.39 |

*Primary Examiner*—David A. Scherbel
*Assistant Examiner*—Anthony Ojini
*Attorney, Agent, or Firm*—Michael J. Striker

[57] ABSTRACT

A fluid-operated tool for tightening and loosening threaded connectors has a ratchet unit including a ratchet connectable with a threaded connector to be tightened and loosened and provided with a plurality of teeth, and a pawl engageable in and disengageable from the teeth of the ratchet, a drive connected with the ratchet and movable over an advance stroke to turn the ratchet when the pawl engages the teeth of the ratchet so as to turn a threaded connector connected with the ratchet for tightening or loosening, and a retract stroke in which the pawl is disengaged from the teeth of the ratchet, and a unit for sensing when the pawl falls into engagement with a tooth of the ratchet and in response reversing the drive from the retract stroke to the advance stroke.

4 Claims, 1 Drawing Sheet

FLUID-OPERATED TOOL

BACKGROUND OF THE INVENTION

The present invention relates generally to fluid operated tools, and more particularly to such fluid operated tools which have drive means and a ratchet-pawl mechanism including a ratchet connectable to a threaded connector to be tightened and loosened, for example a bolt, a nut, etc. and a pawl which is engageable with and disengageable from the teeth of the ratchet under the action of the drive means.

One of such tool is disclosed for example in U.S. Pat. No. 4,409,865. In this tool a lever mechanism has two drive pawls. While one drive pawl, engages the ratchet during a forward stroke of the piston, the other pawl is tilted back so as to slip over the ratchet teeth and to engage the ratchet tooth on the retract stroke of the piston while at that time the first drive pawl is tilted back. Therefore the ratchet turns forward both during the advance stroke and the retract stroke of the piston.

The problem is that during use of this tool on an actual bolting application, the nut is turned from tight to loose or from loose to tight. When the nut is being tightened and the turning resistance of the nut gets greater with each stroke, the flexing of the lever mechanism gets greater. This in turn requires a built-in overstroke which can be 50% more than the actually calculated stroke. This means, that on a loose nut the pawl which moves backward to catch another tooth falls in way behind that tooth and thus has a free forward movement when the piston moves the other way, until the front of the pawl hits the ratchet tooth. That unnecessary free forward movement can be quite extensive when the nut is loose and there is turning resistance, but becomes quite minimal when high torque is being applied to the nut. This means that when the nut is loose, a good part of the piston stroke is used just to overcome the overstroke and have the pawl engaged with the ratchet tooth. When the nut is tighter, on the other hand, the overstroke is absorbed by the material flex. Since the mechanism is described in the above mentioned patent allows for a continuous turning of the ratchet and thus the threaded connector which the ratchet engages, it is important to eliminate the overstroke when the nut is loose, since otherwise, the turning motion will be interrupted each time the tool switches from an advance stroke to a retract stroke.

SUMMARY OF THE INVENTION

Accordingly, it is an object of the present invention to provide a fluid-operated tool which eliminates the disadvantages of the prior art.

In keeping with these objects and with others which will become apparent herein after, one feature of present invention resides, briefly stated, in a fluid operated tool which has ratchet means including a ratchet connectable with a threaded connector to be tightened and loosened and provided with a plurality of teeth, and at least one pawl engageable in and disengageable from the teeth of the ratchet, drive means connected with the ratchet means and movable over an advance stroke to turn the ratchet when the at least one pawl engages the teeth of the ratchet so as to turn a threaded connector connected with the ratchet for tightening or loosening, and a retract stroke in which the at least one pawl is disengaged from the teeth of the ratchet, and means for sensing when the at least one pawl falls into engagement with a tooth of the ratchet and in response reversing the drive means from the retract stroke to the advance stroke.

When the fluid-operated tool is designed in accordance with the present invention, it eliminates the above mentioned disadvantages of the prior art and provides for highly advantageous results.

In accordance with another embodiment of the present invention, the fluid-operated tool has a second pawl which is also engageable with the teeth of the ratchet and arranged so that during the advance stroke of the drive means the second pawl slips over the teeth of the ratchet while during the retract stroke of the drive means the second pawl engages with the teeth of the ratchet and turn the ratchet in a same direction, and second sensing means is associated with the second pawl so as to sense when the second pawl falls into engagement with the tooth of the ratchet and in response to reverse the drive means from the forward stroke to the retract stroke.

When the fluid-operated tool is designed in accordance with the present invention, rather than changing direction of the piston of the drive means when the piston is fully extended or retracted, as is common in conventional tools, the piston changes direction immediately when the corresponding pawl falls into engagement. This provides a much faster free and low torque tightening and loosening operation. Taking into consideration that the hydraulic power packs in hydraulically-operated tools have a relatively low oil flow, the use of sensing means to sense the respective pawl movement can easily speed up the operation by 50%, especially during low torque applications.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
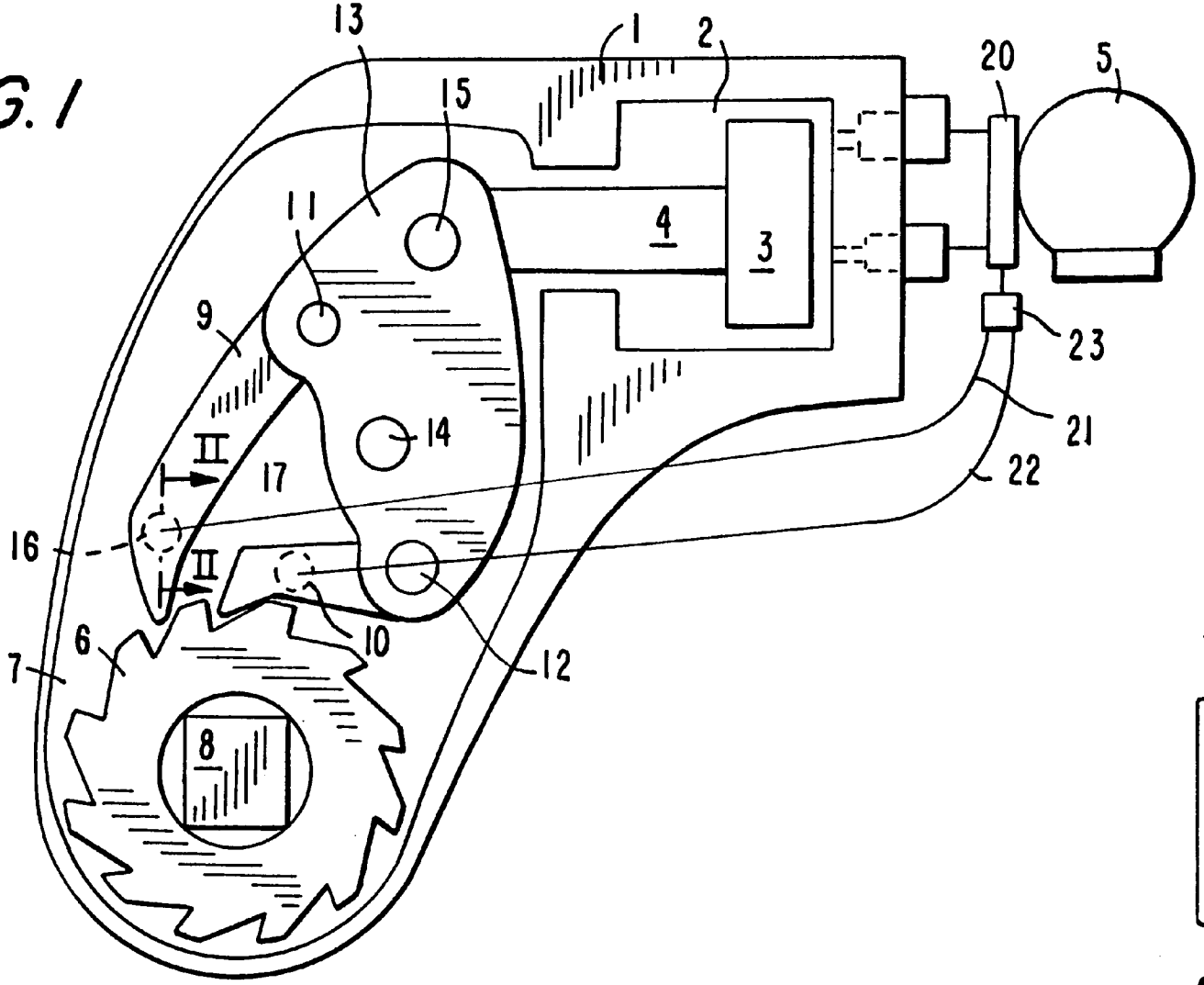
FIG. 1 is a view schematically showing a fluid-operated tool for tightening and loosening of threaded connectors in accordance with the present invention.

A fluid-operated tool in accordance with the present invention has a housing which is identified as a whole with reference numeral 1. The tool is provided with drive means which include a cylinder 2 formed in the housing 1 and a piston 3 reciprocatingly movable in the cylinder 2 and having a piston rod 4. The cylinder 2 communicates with a pump 5 which supplies a working fluid into and withdraws the working fluid from the cylinder 2.

The fluid-operated tool further has a ratchet-pawl mechanism which includes a ratchet 6 provided on its outer periphery with a plurality of teeth. The ratchet 6 is turnably supported between two support plates 7 fixed in the housing 1. It has an inner polygonal opening with which it can be fitted on an outer polygonal surface of a threaded connector, for example a nut, or a central shaft 8 which can be connected with a socket engageable in turn with the threaded connector. The ratchet-pawl mechanism further has two pawls 9 and 10. Each pawl has a front end provided with a tooth and a rear end pivotably connected by a pivot pin 11 and 12 correspondingly to a drive plate 13. The drive plate 13 is pivotably connected with the support plate 7 by a pivot pin 14. The free end of the piston rod 4 of the drive means is pivotably connected with the drive plate 13 by a pivot pin 15.

During the operation of the fluid-operated tool, the piston 3 under the action of the working fluid supplied by the pump 5 into the cylinder 2 is displaced to the left in the drawings (forward stroke), the drive plate 13 is turned in counter clockwise direction and the pawl 9 engaging between the teeth of the ratchet 6 is displaced so as to turn the ratchet 6 and therefore a threaded connector engaged by it also in counter clockwise direction. During the advance stroke the pawl 10 just slips over the teeth of the ratchet 6. Then the piston 3 under the action of the working fluid is moved to the right in the drawings (retract stroke), and the drive plate 13 is turned in clockwise direction, the pawl 10 engages between the teeth of the ratchet 6 and is displaced so as to turn the ratchet 6 and therefore a threaded connector engaged by the ratchet also in counter clockwise connection. At that time the pawl 9 just slips over the teeth of the ratchet. Therefore the threaded connector engaged by the ratchet 6 turns in the same direction both during the advance stroke and the retract stroke.

In accordance with the present invention the pawls 9 and 10 are provided with sensing means 16 and 17 correspondingly. Each of the sensing means 16, 17 is formed so that it senses when the corresponding pawl 9 or 10 falls into engagement with the tooth of the ratchet 6 and sends a signal for reversing the stroke of the drive means through control lines 21 and 22 to a control unit 23 of a pump valve 20. In particular, when the sensing means 16 of the pawl 9 senses that the pawl 9 falls into engagement with the tooth of the ratchet 6, it sends a signal to the valve 20 of the pump 5, to act on the working fluid so as to switch from the retract stroke of the piston 3 to the advance stroke. The sensing means 17 of the pawl 10 sense when the pawl 10 falls into engagement with the tooth of the ratchet 6 and sends a signal to the valve 20 of the pump 5 to provide the action of the working fluid so as to switch from the advance stroke of the piston 3 to the retract stroke. As a result, the piston 3 changes its direction not when it is completely extended or retracted, but instead when the corresponding pawl 9, 10 falls into engagement with the teeth of the ratchet 6.

Figure 2:
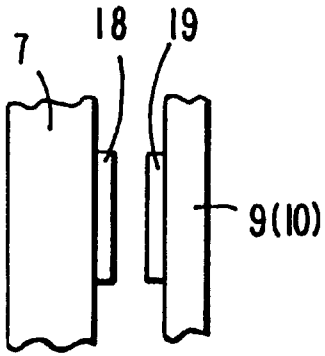
FIG. 2 is a view showing a section taken along the lines II—II in FIG. 1.

Each of the sensing means 16, 17 can be formed for example as shown in FIG. 2. The sensing means can include, for example, a Hall sensor fixed to the support plate 7 and a magnet 19 fixed to a corresponding pawl 9 or 10. When the magnet 19 reaches the Hall sensor 18, the latter sends a signal to the pump 5. It is to be understood that the position of the Hall sensor 18 and the magnet 19 is selected so as to sense a desired degree of engagement of the corresponding pawl with the teeth of the ratchet.

While FIG. 1 shows the fluid-operated tool with two drive pawls, such as for example disclosed in U.S. Pat. No. 4,409,865, it is to be understood that the present application is applicable to fluid-operated tools provided with a single pawl, such as shown for example in U.S. Pat. Nos. 4,201,099 and 5,005,447. Once the pawl falls into the ratchet tooth after ratching backwards, an immediate forward movement saves a lot of time as well.

It will be understood that each of the elements described above, or two or more together, may also find a useful application in other types of constructions differing from the types described above.

While the invention has been illustrated and described as embodied in fluid-operated tool, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid-operated tool for tightening and loosening threaded connectors, comprising ratchet means including a ratchet connectable with a threaded connector to be tightened and loosened and provided with a plurality of teeth, and at least one pawl engageable in and disengageable from said teeth of said ratchet; drive means connected with said ratchet and movable over an advance stroke to turn said ratchet when said at least one pawl engages said teeth of said ratchet so as to turn a threaded connector connected with said ratchet for tightening and loosening, and a retract stroke in which said at least one pawl is disengaged from said teeth of said ratchet; and means for sensing when said at least one pawl falls into engagement with a tooth of said ratchet and in response reversing said drive means from said retract stroke to said advance stroke.

2. A fluid-operated tool as defined in claim 1; and further comprising a second pawl which is also engageable with said teeth of said ratchet and arranged so that during said advance stroke of said drive means said second pawl slips over said teeth of said ratchet while during said retract stroke of said drive means said second pawl engages with said teeth of said ratchet and turns said ratchet in a same direction, said sensing means being associated with said first mentioned pawl; and second sensing means associated with said second pawl so as to sense when said second pawl falls into engagement with the tooth of said ratchet and in response to reverse said drive means from said forward stroke to said retract stroke.

3. A fluid-operated tool as defined in claim 1; and further comprising a support member relative to which said at least one pawl is movable, said sensing means including a first sensing element arranged on said at least one pawl and a second sensing element arranged on said support member, so that when said at least one pawl falls into engagement with a tooth of said ratchet, said sensing elements interact with one another so as to produce a signal for reversing said drive means from said retract stroke to said advance stroke.

4. A fluid-operated tool as defined in claim 3, wherein one of said sensing elements is a magnet, while another of said sensing elements is a Hall sensor.

* * * * *